United States Patent [19]

Takai

[11] 4,358,871

[45] Nov. 16, 1982

[54] HOOK AND PIN HINGED CONNECTION

[75] Inventor: Akio T. Takai, Romeo, Mich.

[73] Assignee: General Motors Corporation, Detroit, Mich.

[21] Appl. No.: 245,746

[22] Filed: Mar. 20, 1981

[51] Int. Cl.[3] ..... E05D 11/06; E05D 5/08

[52] U.S. Cl. ..... 16/262; 16/267

[58] Field of Search ..... 16/262, 387, 260, 267

[56] References Cited

U.S. PATENT DOCUMENTS 3,195,920 7/1965 Knisely et al. ..... 16/267 X 3,451,096 6/1969 Leshin ..... 16/260

*Primary Examiner*—Werner H. Schroeder

*Assistant Examiner*—Andrew M. Falik

*Attorney, Agent, or Firm*—Patrick M. Griffin

[57] ABSTRACT

A molded hinge mechanism includes a pair of hinge members having open slotted barrel portions which may be molded integrally with the hinge members without the necessity of core inserts or separate drilling operations. The hinge members include at least one pair of interfitting semi-cylindrical surfaces generated about the common axis of the barrel portions which slidably engage with one another as the hinge members rotate relatively about the axis. The slots which contain the hinge pin are open and the slidable interfitting of the semi-cylindrical surfaces prevents the hinge members from separating when the slots are oriented 180° oppositely. Since the semi-cylindrical surfaces do not intrude into the open slots, each hinge member may be molded in a one step operation without the necessity of drilling or inserts.

2 Claims, 4 Drawing Figures

HOOK AND PIN HINGED CONNECTION

BACKGROUND OF THE INVENTION

This invention relates to molded hinge mechanisms, specifically the type having open slotted barrel portions which can be molded integrally with the hinge without the necessity of core inserts in the mold or a separate drilling operation.

It has been recognized in the prior art that it is desirable to mold hinge mechanisms of the type which have barrels containing open slots other than the usual closed, tubular barrels. This structure allows the hinge members to be molded without the necessity for core inserts or a separate drilling operation which adds expense to the molding process. However, it is necessary in this type of hinge mechanism to prevent the hinge members from separating when the open slots in the barrels are disposed 180° apart while not interfering with the rotation of the hinge members. U.S. Pat. No. 2,500,829 to Jacobson, issued Feb. 15, 1947, discloses a hinge mechanism with a series of interfitting, coaxially aligned, open slotted barrels held together by a pin. Cooperating interlocking stop members on the axial ends of each barrel serve to limit the angular displacement of the hinge members relative to one another and prevent separation of the hinge members when the open slots in the barrels are disposed 180° apart. However, the stop members which are in the form of small, interlocking pie-shaped segments, contact one another only over a relatively small surface area which limits the strength of the connection between the hinge members.

SUMMARY OF THE INVENTION

The subject invention solves the above outlined problems for this type of molded hinge mechanism by providing a hinge mechanism with open slotted barrel portions which include at least one pair of interfitting, semi-cylindrical surfaces generated about a common axis, each such semi-cylindrical surface slidably engaged with a matching semi-cylindrical surface on the other hinge member as the hinge members relatively rotate about a pin through the common axis. This slidable engagement of the matching semi-cylindrical surfaces prevents the hinge members from separating when the open slots in the barrel portions are directed 180° oppositely to one another. This sliding engagement to retain the respective semi-cylindrical surfaces is continuous over substantially the whole length of the hinge members' common axis and provides resistance to any separation of the hinge members when the hinge members are oriented such that the open slots in the barrels are disposed 180° apart.

BRIEF DESCRIPTION OF THE DRAWINGS

These and other features appear from the following written description and drawings wherein.

DESCRIPTION OF THE PREFERRED EMBODIMENT

Figure 1:
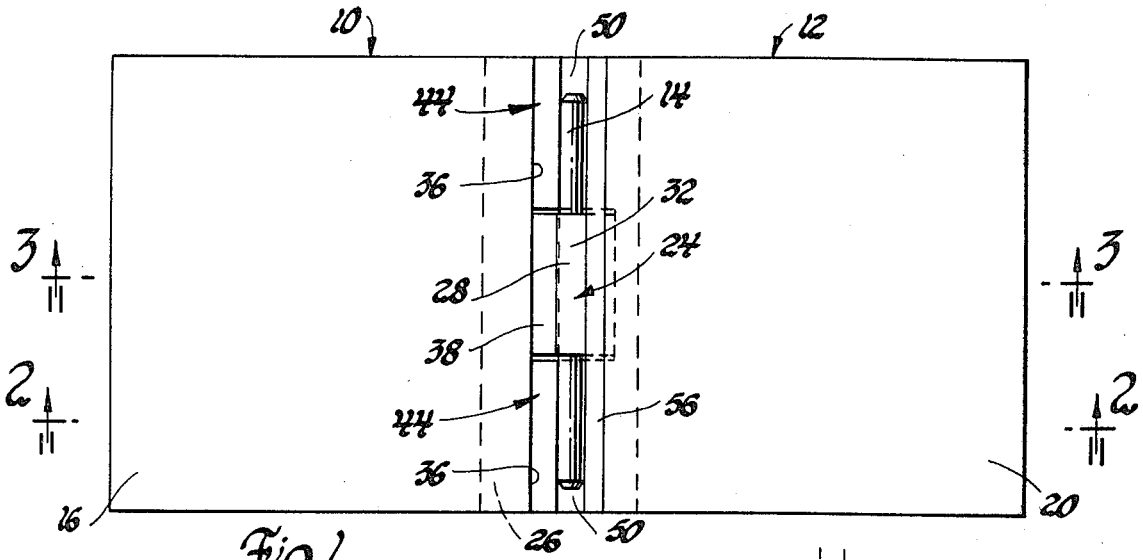
FIG. 1 is a plan view of the hinge mechanism of the invention, with the hinge members oriented relative to one another such that the slots in the barrel portions are disposed 180° apart.

Referring now to the drawings, the hinge mechanism of the invention includes first and second hinge members 10 and 12 made of molded plastic material. Hinge members 10 and 12 are joined together for relative rotation about hinge pin 14 which defines a common axis of rotation of the hinge members, this same common axis about which the other elements of the invention are generated. Hinge member 10 includes a first side 16 and a second side 18, and similarly hinge member 12 includes first side 20 and second side 22. These sides serve no function in themselves but serve to orient the slots in the hinge members for purposes of discussion.

A generally U-shaped barrel portion 24 is integrally molded with an edge portion 26 of hinge member 10. Barrel portion 24 includes a bight portion 28 respective to first side 16 and an open, linear slot 30 opening to the second side 18. The outer surface 32 of bight 28 defines a semi-cylindrical surface which is generated about the common axis of rotation of the hinge members defined by pin 14. Outer surface 32 merges into a generally planar surface 34 which is generally parallel to a pair of planar surfaces 36 on either side of barrel portion 24 which surfaces are also integral with edge portion 26. Semi-cylindrical outer surface 32 also merges respective to side 16 into a sloped planar surface 38. Completing the construction of hinge member 10, the planar surfaces 36 on either side of barrel portion 24 merge into a pair of like-shaped, semi-cylindrical surfaces 40, also generated about the common axis of hinge pin 14, surfaces 40 terminating in a lip 42 which does not extend into slot 30. It is this non-extension of cylindrical surface 40 into slot 30 which assures that hinge member 10 may be molded without the necessity of core inserts.

Hinge member 12 includes a pair of like-shaped barrel portions 44, separated by the width of barrel portion 24 on hinge member 10 which are integrally molded with edge portion 46 of hinge member 12 and axially aligned along the common axis of hinge pin 14. Each bight portion 48 of barrel portion 44 is respective to second side 22 of hinge member 12 and includes therein an open, linear slot 50 opening respective to the first side 20. The outside surfaces 52 on each barrel portion 44 define semi-cylindrical surfaces generated about the common axis of hinge pin 14 of like shape and aligned with one another. Each semi-cylindrical surface 52 merges into edge 46 of hinge member 12. That portion of edge 46 extending between barrel portions 44 merges into a semi-cylindrical surface 54 also generated about the common axis of the hinge pin 14. A sloped planar surface 56 extends continuously across hinge member 12 above slots 50. Sloped surface 56 does not extend into slots 50 which again assures that the hinge member may be molded without the necessity for core inserts.

Figure 2:
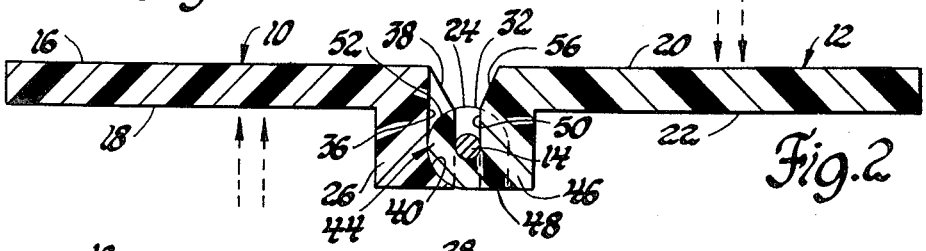
FIG. 2 is a sectional view taken along the line 2—2 of FIG. 1.
Figure 3:
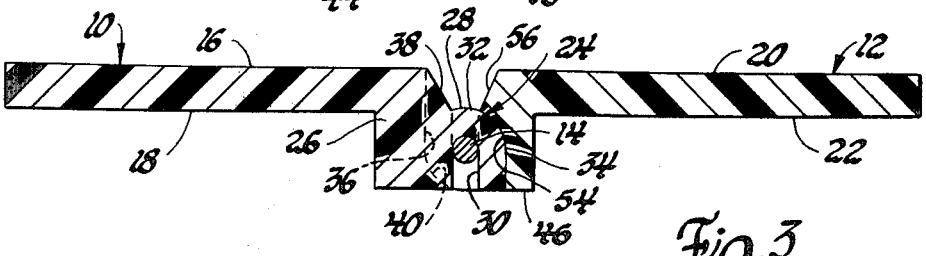
FIG. 3 is a sectional view taken along the line 3—3 of FIG. 1.
Figure 4:
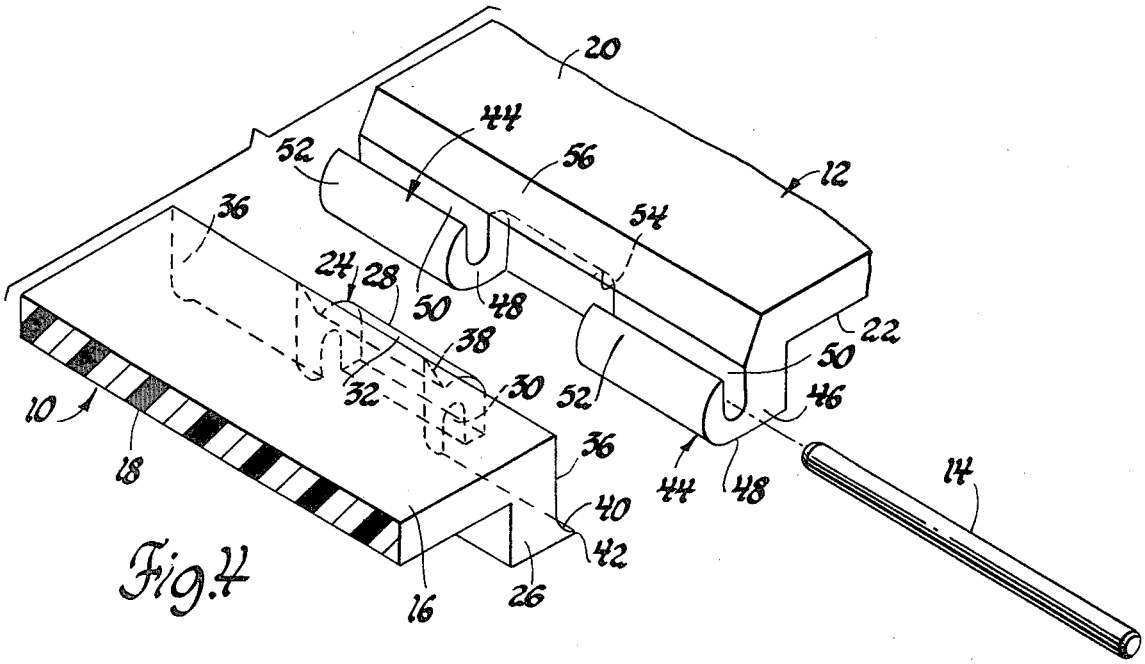
FIG. 4 is a partial perspective view of the hinge members separated from one another with the hinge pin removed.

The fact that the open slots are not obstructed in the construction of the hinge member while allowing the hinge member to be molded without core inserts, also creates the necessity for another means to prevent separation of the hinge members when the open slots are disposed 180° apart. This prevention of separation results from the manner in which the hinge members are fitted together. Barrel portion 24 on hinge member 10 interfits between the aligned barrel portions 44 of hinge member 12. Because all of the described semi-cylindrical surfaces are generated about the common axis of hinge pin 14, it is apparent that semi-cylindrical surface 32 is engaged in sliding contact with semi-cylindrical surface 54 while the two semi-cylindrical surfaces 52 are in sliding contact with the two semi-cylindrical surfaces 40. The similar shape of these surfaces allows the hinge member to rotate relative to one another about the common axis of hinge pin 14, but when the hinge members 10 and 12 are disposed as shown in FIGS. 2 and 3 with the open slots 30 and 50 disposed 180° apart, the contact of these surfaces prevents the hinge members from separating when forced in the relative direction indicated by the arrows in FIG. 2. This interfitting of hinge members 10 and 12 automatically aligns the slots therein so that the overlap of slots 30 and 50 forms a journal along a common axial line through the bottom of each slot. Hinge pin 14 is inserted in this overlap.

The extent of the relative rotation of hinge members 10 and 12 is limited in one direction by the sloped surfaces 38 and 56. If the hinge members as seen in FIG. 2 are folded upwardly, the contact of surfaces 38 and 56 which comprise stop means and which define a relative angle of about 45° prevents further rotation. The angle of these surfaces may be changed to allow a greater relative rotation, up to approximately 90°. If the hinge members are rotated in the other direction, it can be seen by referring to FIG. 3 that because of the fairly tight engagement of planar surfaces 34 and 54, little if any rotation in that direction is possible. However, it would be possible to generate a semi-cylindrical surface 32 completely about hinge pin 14 which would allow greater relative rotation of hinge members 10 and 12 in the other direction. In this event, it would be necessary that lip 42 contact edge 46 of hinge member 12 before the relative rotation of hinge members reaches 90°, in order to prevent separation of the hinge members from the hinge pin. This amount of relative rotation is, of course, suitable for many applications.

Thus, a molded hinge mechanism is provided wherein the hinge members may be molded without the necessity of core inserts or a separate drilling operation.

The embodiments of the invention in which an exclusive property or privilege is claimed are defined as follows:

1. A molded hinge mechanism comprising, first and second hinge members, each having at least one barrel portion provided with an open linear slot, said slots opening oppositely of each other and being axially aligned, a hinge pin axially insertable in the aligned open slots to pivot the hinge members together for relative rotative movement about a hinge axis, each hinge member further including an outer convex semi-cylindrical surface on the bight of the barrel portion generated about the hinge axis, each hinge member further including a complementary concave semi-cylindrical surface also generated about the hinge axis and slidably engageable with the convex semi-cylindrical surface on the barrel portion of the other hinge member, the hinge members further including stop means adjacent the convex and concave surfaces and engageable as the hinge members rotate about the hinge axis to limit the relative rotation of the hinge members about the hinge axis and maintain the hinge pin in the axially aligned open slots, the slidable engagement of the respective convex and concave semi-cylindrical surfaces preventing the separation of the hinge members as they rotate relative to one another about the hinge axis.

2. A molded hinge mechanism comprising, first and second two sided hinge members, each hinge member having at least one barrel portion provided with an open linear slot, said slots opening oppositely of each other and being axially alignable, a hinge pin axially insertable in the aligned open slots to pivot the hinge members together for relative rotative movement about a hinge axis, each hinge further including an outer convex semi-cylindrical surface on the bight of the barrel portion generated about the hinge axis, the convex semi-cylindrical surface on one hinge member merging into an edge portion respective one side of said one hinge member, each hinge member further including a complementary concave semi-cylindrical surface also generated about the hinge axis and terminating in a lip respective the same one side of said other hinge member, the convex and concave semi-cylindrical surfaces of the hinge members being slidably engageable, the respective edge portion and lip of the hinge members being engageable as the hinge members rotate relative to one another in one direction to limit the relative rotation and maintain the hinge pin within the axially aligned open linear slots, each hinge member including a stop member respective the other side thereof, the stop members being engageable to limit the relative rotation of the hinge members in the other direction to maintain the hinge pin in the axially aligned open slots, the slidable engagement of the respective convex and concave semi-cylindrical surfaces preventing the separation of the hinge members in all relative rotative positions thereof.

* * * * *